US007645037B2

(12) United States Patent
Massey

(10) Patent No.: US 7,645,037 B2
(45) Date of Patent: Jan. 12, 2010

(54) PRINTER STRUCTURE

(75) Inventor: Samuel A. Massey, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1036 days.

(21) Appl. No.: 10/798,509

(22) Filed: Mar. 11, 2004

(65) Prior Publication Data

US 2005/0200652 A1 Sep. 15, 2005

(51) Int. Cl.
*B41J 2/01* (2006.01)

(52) U.S. Cl. ..... 347/105; 400/656

(58) Field of Classification Search ..... 347/104, 347/15, 12, 43, 19, 13, 42, 4, 105; 358/1.2, 358/1.9, 3.02–3.06; 400/585, 588, 649, 653, 400/656, 659

See application file for complete search history.

(56) References Cited

U.S. PATENT DOCUMENTS

| | | | | |
|---|---|---|---|---|
| 4,701,771 | A | 10/1987 | Ikeda | |
| 4,975,780 | A | 12/1990 | Kuboki | |
| 5,173,596 | A | 12/1992 | Kapinos et al. | |
| 5,192,141 | A | 3/1993 | Chung et al. | |
| 5,291,227 | A | 3/1994 | Suzuki | |
| 5,393,151 | A | 2/1995 | Martin et al. | |
| 5,510,815 | A | 4/1996 | Linder et al. | |
| 5,517,222 | A | 5/1996 | Sugiyama et al. | |
| 5,571,587 | A | 11/1996 | Bishop et al. | |
| 5,627,571 | A | 5/1997 | Anderson et al. | |
| 5,659,342 | A | 8/1997 | Lund et al. | |
| 5,677,719 | A | 10/1997 | Granzow | |
| 5,686,944 | A | 11/1997 | Takagi et al. | |
| 5,719,602 | A | 2/1998 | Hackleman et al. | |
| 5,771,052 | A | 6/1998 | Hine et al. | |
| 5,997,129 | A | 12/1999 | Matsuhashi | |
| 6,206,500 | B1 | 3/2001 | Hirano et al. | |
| 6,239,817 | B1 * | 5/2001 | Meyer | 347/36 |
| 6,305,791 | B1 * | 10/2001 | Hotomi et al. | 347/70 |
| 6,454,374 | B1 | 9/2002 | Therien | |
| 6,481,824 | B1 | 11/2002 | Hayakawa et al. | |
| 6,481,827 | B2 | 11/2002 | Yearout | |
| 6,575,554 | B2 | 6/2003 | Yoshinaga | |
| 6,986,574 | B2 * | 1/2006 | Nojima et al. | 347/104 |
| 2002/0070991 | A1 * | 6/2002 | Otsuki | 347/16 |

FOREIGN PATENT DOCUMENTS

| | | |
|---|---|---|
| EP | 0995 603 | 4/2000 |
| JP | 10217502 | 8/1998 |
| JP | 10 244680 | 9/1998 |
| JP | 2000118058 | 4/2000 |
| JP | 2001 88375 | 4/2001 |
| JP | 2003 39753 | 2/2003 |

* cited by examiner

*Primary Examiner*—Lamson D Nguyen

(57) ABSTRACT

A structure has an edge configured to contact an underside of a medium along a media path. The edge extends path across a majority of a width of the media path.

52 Claims, 5 Drawing Sheets

PRINTER STRUCTURE

BACKGROUND

Borderless printing generally involves ink being sprayed over the edges of a print medium. Ink that is not deposited on the medium along the edges is typically collected in an underlying absorber. However, during printing, ink aerosol frequently becomes deposited upon adjacent structures that support the medium. The ink aerosol deposited on such structures is frequently transferred to the bottom side of the print medium, causing streaks.

DETAILED DESCRIPTION OF EXAMPLE EMBODIMENT

Figure 1:
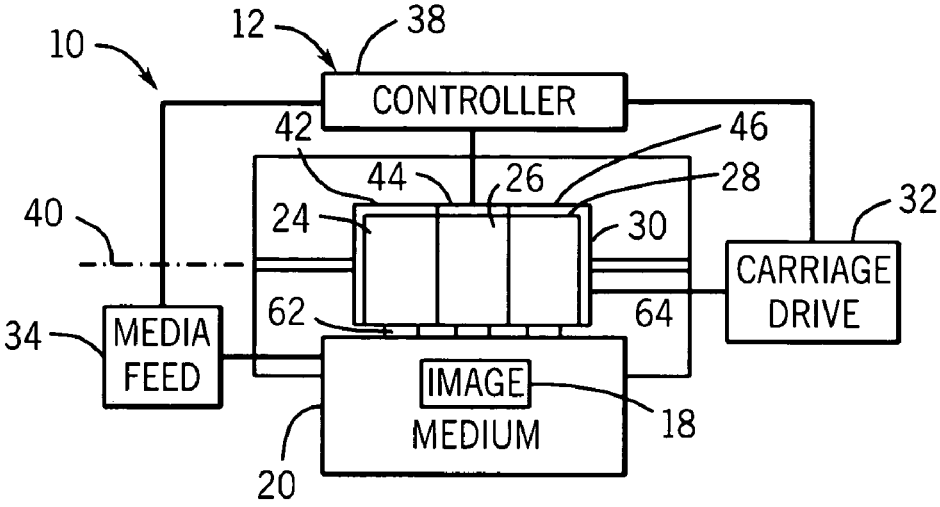
FIG. 1 is a schematic illustration of an example of a printer.

FIG. 1 is a schematic illustration of printing system 10. Printing system 10 is generally configured to print an image 18 upon a print medium 20. System 12 includes printer 12 and print cartridges 24, 26 and 28 having printheads 62. Printer 12 includes carriage 30, carriage drive 32, media feed device 34 and controller 38. Carriage 30 generally comprises a structure configured to be moved back and forth across medium 20 along a scan axis 40 while supporting at least one print cartridge. In the particular embodiment illustrated, carriage 30 includes one or more of print cartridge locations 42, 44 and 46. Print cartridge locations 42, 44 and 46 generally comprise structures along carriage 30 that are configured to hold or retain an individual print cartridge. Print cartridge locations 42, 44 and 46 are configured such that each of print cartridges 24, 26 and 28 is interchangeable with one another. Carriage 30 may alternatively be configured to specifically support a particular one of print cartridges 24, 26 and 28. The exact configuration of such print cartridge locations may be varied depending upon the exact configuration of the print cartridge to be held or retained at the print cartridge location, as well as the type of connecting or supporting arrangement employed at each print cartridge location. In some embodiments, the carriage 30 is configured to support a single printing cartridge.

Carriage drive 32 is shown schematically and generally comprises an actuator configured to move carriage 30 along scan axis 40 across medium 20 in response to control signals from controller 38. Media feed device 34, schematically shown, comprises one or more mechanisms, such as belts, pulleys, drive rollers and motors, configured to feed and move medium 20 relative to carriage 30 and whatever print cartridges are supported at print cartridge locations 42, 44 and 46. As will be described in greater detail hereafter with respect to FIGS. 3-7, media feed device 34 is specifically configured to position at least one edge of medium 20 opposite print cartridges 24, 26 or 28 to enable ink to be deposited up to the one or more edges of medium 20. At the same time, media feed device 34 is configured to minimize the deposition of ink on a back side of medium 20. The exact configuration of media feed device 34 may be varied depending upon the characteristics of medium 20 being fed past carriage 30. For example, media feed device 34 may have different configurations depending upon the particular dimensions of medium 20.

Controller 38 generally comprises a processor unit configured to generate control signals which are transmitted to carriage drive 32, media feed device 34 and whatever print cartridges 24, 26, 28 that are mounted to carriage 30. Controller 38 may comprise a processing unit that executes sequences of instructions contained in a memory (not shown). Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 38 is not limited to any specific combination of hardware circuitry and software, nor to any particular source for the instructions executed by the processing unit.

Controller 38 receives data representing an image to be printed from any of a variety of suitable sources, including a media reader 36, a computer, a scanner, or directly from memory of a device, such as a video camera, digital camera and the like. Controller 38 further senses the characteristics and locations of print cartridges 24, 26, 28 or other print cartridges mounted to carriage 30. Based upon such information, controller 38 controls carriage drive 32 to move carriage along scan axis 40, controls media feed device 34 to move medium 20 relative to carriage 30 in directions generally perpendicular to scan axis 40, and controls the application of inks from one or more of print cartridges 24, 26, 28, 14 or 16 supported by carriage 30. In other embodiments, printer 12 may be configured for use with a fewer or greater number of print cartridges.

Figure 2:
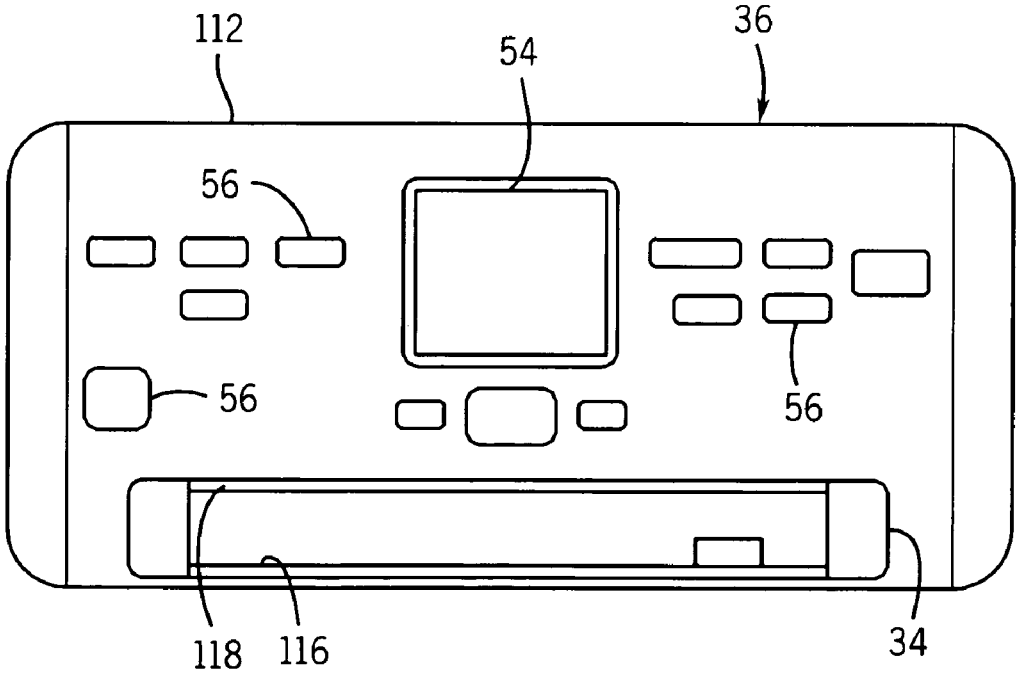
FIG. 2 is a front elevational view of a specific embodiment of the printer of FIG. 1.
Figure 3:
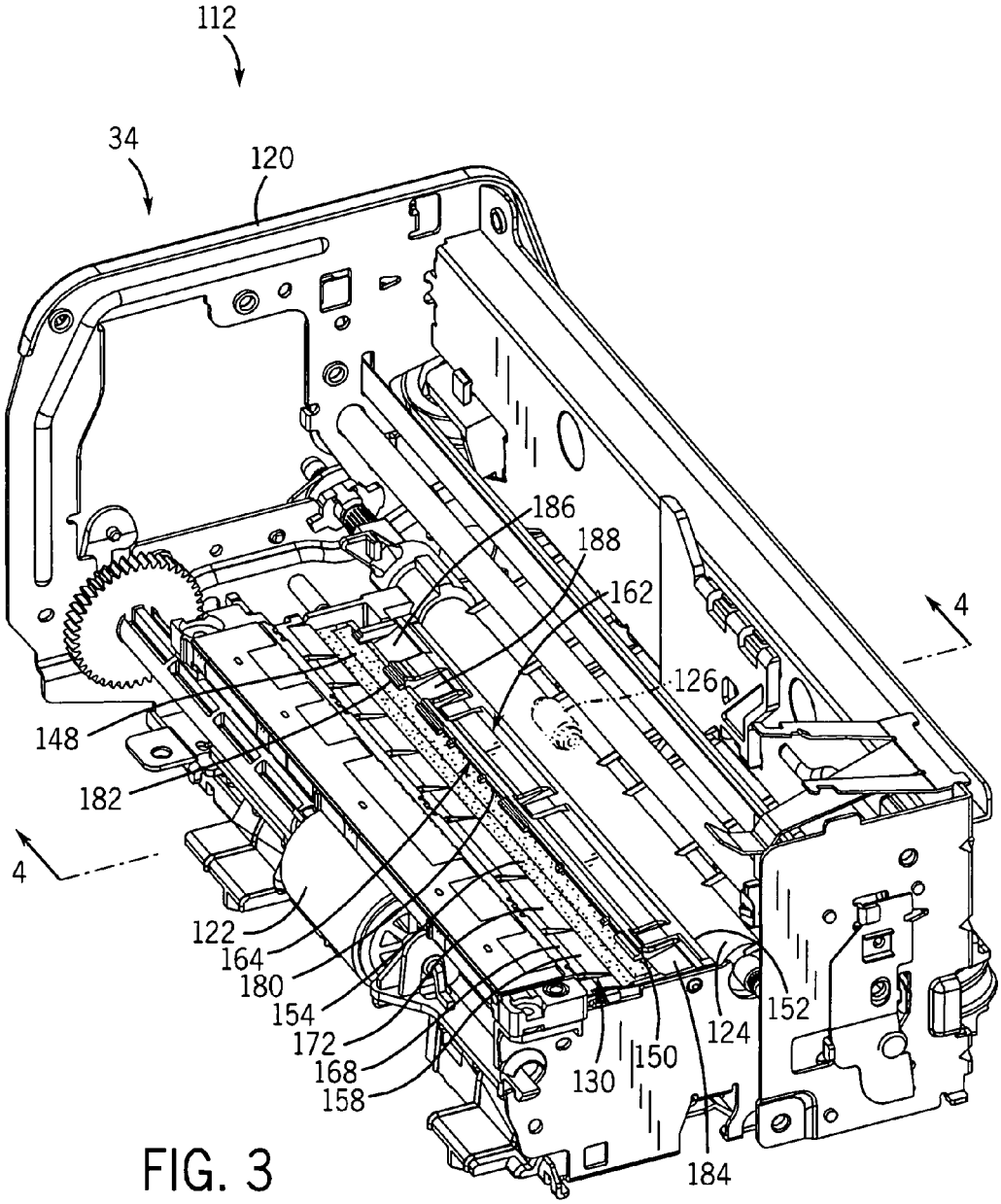
FIG. 3 is a top perspective view of one embodiment of a media feed device of the printer of FIG. 2.

FIG. 2 illustrates printing system 112, a specific embodiment of printing system 12 schematically illustrated in FIG. 3. For ease of discussion, those elements of printing system 112 which correspond to elements of printing system 12 are numbered similarly. In addition to those elements illustrated in FIG. 2, printing system 112 includes each of the elements described with respect to printing system 12 in FIG. 1. System 112 further includes display 54 and various input devices 56. As shown by FIG. 2, media feed device 34 includes media input 116 and media output 118. Media input 116 includes an opening into which one or more sheets of media are supplied to printing system 112. In the particular embodiment illustrated, media input 116 comprises a tray.

Media output 118 comprises opening within printing system 112 through which the media is ejected after being printed upon. In the particular embodiment illustrated, media output 118 comprises an output tray. Although media input 116 and media output 118 are illustrated as extending in a generally horizontal plane, media input 116 and media output 118 may alternatively extend in a vertical or substantial vertical plane.

Figure 4:
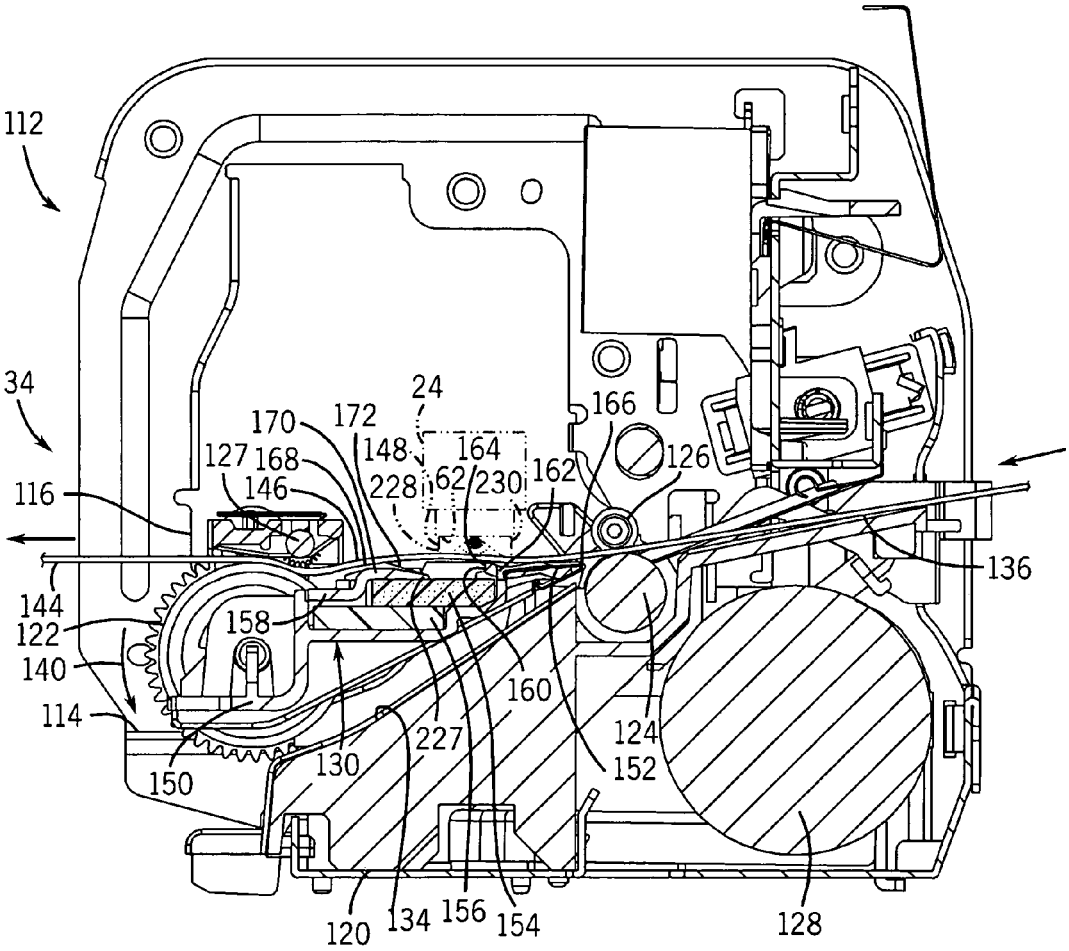
FIG. 4 is a sectional view of the media feed device of FIG. 3 taken along line 4-4, according to an example embodiment.

FIGS. 3-7 illustrate media feed device 34 in greater detail. As shown by FIGS. 3 and 4, media feed device 34 additionally includes frame or housing 120, media transfer member 122, media transfer member 124, pinch member 126, pinch member 127, motor 128 and platen assembly 130. Housing 120 generally comprises one or more structures configured to support the remaining components of media feed device 34 as well as one or more of components of printing system 112. Housing 120 forms a media path 134 (shown in FIG. 4) extending between media transfer member 122 and media transfer member 124 and media path 136 (shown in FIG. 4) extending on an opposite side of media path 134. In alternative embodiments, housing 120 may have other configurations depending upon the configuration of printing system 112 and the path along which the media is to be moved.

Media transfer member 122 comprises a mechanism configured to engage and move a sheet of medium from media input 116 along media path 134 to media transfer member 124. In the particular embodiment illustrated, media transfer member 122 comprises a roller rotatably driven by motor 128 in a direction indicated by arrow 140. In alternative embodiments, media transfer member 122 may comprise a belt rotatably supported by two or more rollers or pulleys, wherein the belt engages the media and moves the media along media path 134.

Media transfer member 124 is configured to engage a medium within media path 134 and to move the medium against pinch member 126 into media path 136 (shown in FIG. 4). Media transfer member 124 is also configured to be rotatably driven in an opposite direction so as to move media within media path 136 across platen assembly 130 and proximate to print cartridge 24 with its printhead 62. In the particular embodiment illustrated, media transfer member 124 comprises a roller rotatably driven by motor 128 while in engagement with pinch member 126 which also comprises a roller. In other embodiments, media transfer member 124 may alternatively comprise a belt rotatably supported by two or more rollers.

Pinch member 126 extends opposite media transfer member 124 and is configured to engage and pinch a medium passing between transfer member 124 and pinch member 126. In the particular embodiment illustrated, pinch member 126 comprises a roller or wheel. In alternative embodiments, pinch member 126 may be provided by a stationary surface or a movable belt.

Pinch member 127 extends generally opposite to media transfer member 122 and is configured to engage a medium as the medium passes between media transfer member 122 and pinch member 127. Pinch member 127 and media transfer member 122 define a media path 146 through and along which media 144 moves from media transfer member 124, across platen assembly 130, between media transfer member 122 and pinch member 127 and through media output 118. In the particular embodiment illustrated, pinch member 127 comprises a star wheel. In other embodiments, pinch member 127 may comprise other movable or stationary structures configured to pinch the media against media transfer member 122.

Motor 128 comprises a device operably coupled to media transfer member 122 and 124 by a drive train (not shown). Motor 128 rotatably drives media transfer members 122 and 124 in response to control signals from controller 38 (shown in FIG. 1). In particular embodiments, motor 128 may additionally function as part of carriage drive 32 (shown in FIG. 1) to drive carriage 30. In still other embodiments, media transfer member 122, media transfer member 124 and carriage 30 may be driven by more than one motor or other power source.

Platen assembly 130 is configured to support a sheet of media 144 within a print zone 148 during printing. As shown by FIG. 3, print zone 148 is generally the area below printhead 62 onto which ink may be deposited as carriage drive 32 moves carriage 30 and one or more of print cartridges 24, 26, 28 along scan axis 40 (shown in FIG. 1). Print zone 148 generally has a transverse width that extends perpendicular to the direction in which medium 144 is moved through print zone 148. The width of print zone 148 is sufficiently large such that ink may be deposited upon an entire leading edge and side edges of the widest print medium that may be accommodated by printing system 112. Print zone 148 has a longitudinal length extending generally parallel to the direction of travel of medium 144 through print zone 148. The longitudinal length of print zone 148 may vary depending upon whether print system 112 employs a single row of one or more print cartridges or includes longitudinally staggered print cartridges. The exact dimensions of print zone 148 and the exact orientation of print zone 148 may vary depending on the configuration of printhead 62 as well as the orientation of scan axis 40 (shown in FIG. 1).

Platen assembly 130 includes platen 150, platen cover 152, absorber 154, absorber 156 (shown in FIG. 4) and absorber cover 158. Platen 150 comprises a member forming an ink receiving cavity 160 and a launching structure 162. Ink receiving cavity 160 is generally an elongate opening having a width extending across media path 146 adjacent to print zone 148 of printhead 62. Cavity 160 is generally configured to receive ink dispensed from printhead 62 which is not deposited upon medium 144.

Ink absorber 154 generally comprises ink-absorbing material disposed within ink receiving cavity 160. Ink absorber 154 is configured to absorb and temporarily capture ink deposited in cavity 160. In the particular embodiment illustrated, ink absorber 154 comprises an open-cell foam. In alternative embodiments, the other ink-absorbent materials may be employed.

Ink absorber 156 generally comprises ink-absorbing material positioned adjacent to and below ink absorber 154 within ink receiving cavity 160. Ink absorber 156 provides additional ink storing capacity. In the particular embodiment illustrated, ink absorber 156 comprises a felt material which wicks ink away from ink absorber 154. As a result, ink absorber 156 increases the life of ink absorber 154.

In other embodiments, ink absorber 156 or ink absorber 154 may be omitted such that ink is received within ink receiving cavity 160 without being absorbed. In other embodiments, ink receiving cavity 160 may be additionally configured to allow received ink to flow to a remote storage or dispensing location. In other embodiments, other ink recipient arrangements may be employed.

Launching structure 162 comprises that portion of platen 150 that is configured to launch and elevate medium 144 over and above ink receiving cavity 160 opposite printhead 62. Launching structure 162 includes an edge 164 adjacent to ink receiving cavity 160 and in contact with an underside of medium 144. Edge 164 includes only those surface portions that are configured to contact an underside of a supported medium. Edge 164 extends non-parallel to media path 146 across a majority of the length of print zone 148. Because edge 164 extends across a majority of the length of print zone 148 and is in contact with an underside of medium 144, edge 164 prevents or minimizes the amount of ink that is accumulated upon those surfaces of launching structure 162 that come into contact with an underside of medium 144.

Platen cover 152 comprises an elongate V-shaped member which is releasably mounted about end portion 166 of platen 150. Cover 152 is formed from a material and is contoured so as to provide a smooth low friction surface along edge portion 166. Cover 152 assists in preventing medium 144 from becoming caught against end portion 166 as an end portion of medium 144 is pulled through and out of media path 134 and repositioned along media path 146. In alternative embodiments, cover 152 may be omitted or may be integrally formed as part of a single unitary body with platen 150. In still other embodiments in which medium 144 does not move in opposite directions as the medium moves from the input to the output, cover 152 may be omitted.

Absorber cover 158 generally comprises a structure removably coupled to platen 150. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

Cover 158 includes landing portion 168 and cover portion 170. Landing portion 168 generally serves as a surface upon which medium 144 may land after passing across print zone 148 and after being printed upon. Cover portion 170 maintains ink absorbers 154 and 156 within ink receiving cavity 160. Cover portion 170 additionally includes tapered ink return surface 172 upon which collected ink drains to ink absorber 154. In other embodiments, cover 158 may alternatively be integrally formed as part of a single unitary body with platen 150 or may be coupled to other structures adjacent to platen 150.

In operation, one or more sheets of media 144 are placed upon media input. Media transfer member 122, alone or in combination with another media transfer member or roller, engages and moves a single sheet of medium 144 along media path 134 into engagement with media transfer member 124. Media transfer member 124 engages and pinches medium 144 against pinch member 126 and further moves medium 144 along media path 136 until an end of the sheet of medium 144 has moved beyond end portion 166 as detected by a sensing mechanism (not shown). Media transfer member 124 is then rotatably driven in an opposite direction so as to move medium 144 from media path 136 through paper path 146 and across ink receiving cavity 160 and below printhead 62 while printhead 62 deposits ink upon medium 144. Media transfer member 124 continues to drive medium 144 between media transfer member 122 and pinch member 127 to output 118.

Figures 5, 5A:
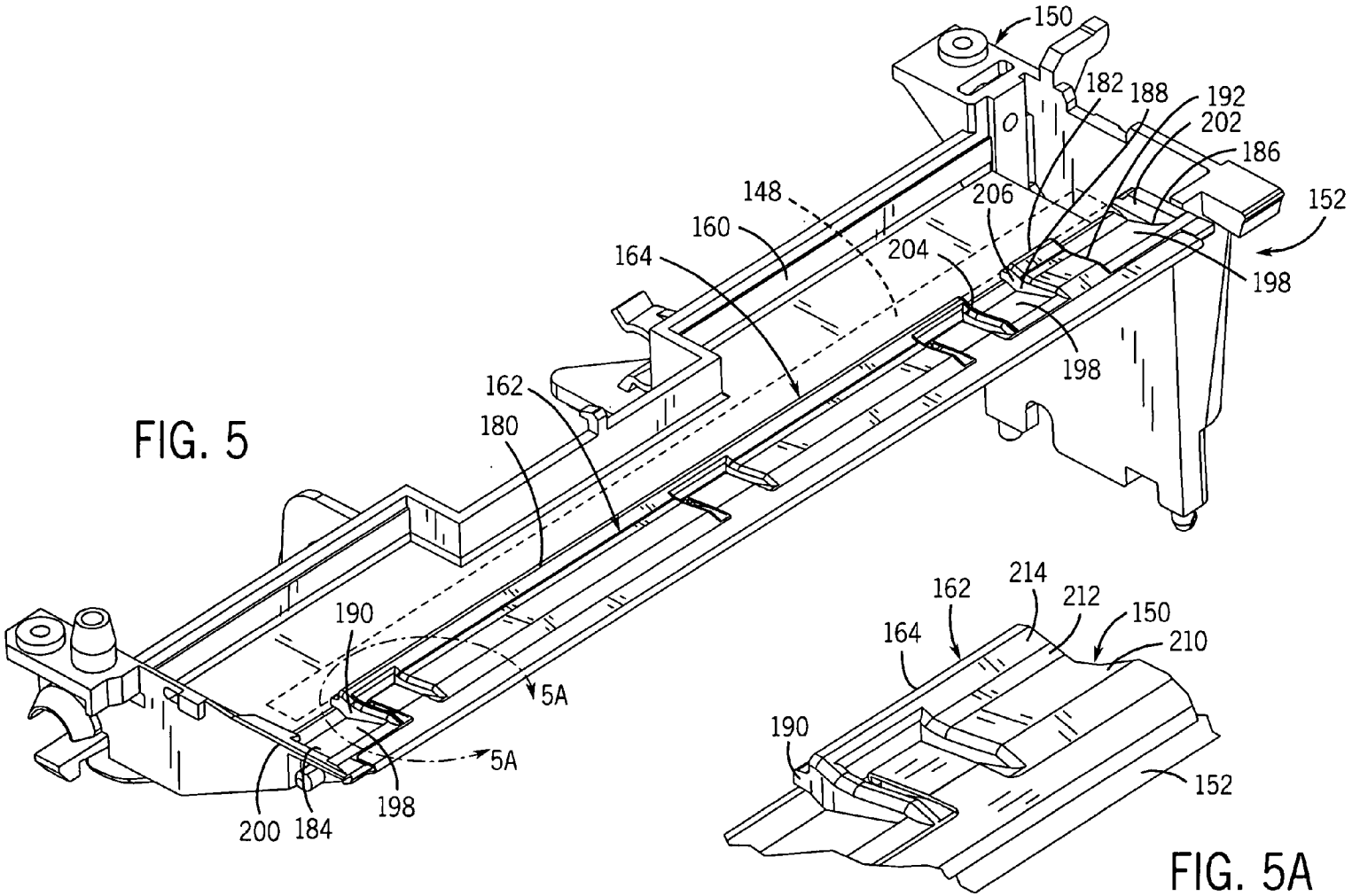
FIG. 5 is a perspective view of a platen assembly of the media feed device of FIG. 3 with portions omitted for purposes of illustration, according to an example embodiment.
FIG. 5A is a fragmentary perspective view of the platen assembly of FIG. 5 taken along line 5A-5A.

FIGS. 5 and 5A illustrate launching structure 162 of platen 150 in greater detail. Edge 164 includes segments 180, 182 and channels 184, 186 and 188. Segment 180 of edge 164 continuously extends along the width of the print zone 148 (shown in phantom lines in FIG. 5) between channels 184 and 188 without interruption. In the particular embodiment illustrated, segment 180 extends parallel to the width of the print zone 148, generally perpendicular to media path 146 (shown in FIG. 3) and perpendicular to the direction that medium 144 travels while being printed upon.

Segment 182 of edge 164 comprises a generally continuous edge portion that is spaced from segment 180 by channel 188. Segment 182 of edge 164 continuously .extends between channels 186 and 188. Segment 182 cooperates with segment 180 to support a medium with the side edges of the medium overhanging channels 184 and 186.

End walls 190 and 192 extend adjacent to channels 184 and 186, respectively, which include tapered floors 198. Channels 184 and 186 are dimensioned and located such that the side edges of a wider medium 144 overhang partially across such channels to enable ink to be deposited on medium 144 adjacent to its side edges. According to one embodiment, the side edges of medium 144 overhang each of end walls 190 and 192 by distance of at least about 2 millimeters and nominally about 3 millimeters. Channels 184 and 186 have a width chosen so as to minimize or prevent ink overspray from collecting upon end walls 190 and 192 or the opposite end walls 200 and 202 of platen 150. In other embodiments, channels 184 and 186 may alternatively be configured to allow ink overspray to be deposited upon end walls 200 and 202. Ink overspray is collected upon floors 198 which guide the flow of collected ink under the force of gravity to ink receiving cavity 160. In some embodiments, suitable dimensions other than those described in the examples set forth herein may be employed.

Segments 180 and 182 cooperate to launch the leading edge of medium 144 over ink receiving cavity 160 while side edges of the medium overhang channels 184 and 186. In the example illustrated, end walls 190 and 192 are spaced from one another and the widths of channels 184 and 186 are configured to accommodate a plurality distinct media widths while permitting printing upon the edges of the media.

In the particular embodiment illustrated, the distance between end walls 190 and 192 is configured to accommodate A6 media, a 4×6 media, and Hagaki media. In the particular embodiment, end walls 190 and 192 are spaced from one another by a distance no greater than 101 millimeters to enable a media having width of 105 millimeters (4.12 inches) (A6 media) to overhang end walls 190 and 192 by at least 2 millimeters. To accommodate media having a width of 101.5 millimeters (4 inches) (4×6 media), end walls 190 and 192 are spaced apart from one another by a distance no greater than 97.5 millimeters to enable the 101.5 millimeters wide media to overhang end walls 190 and 192 by at least 2 millimeters. To accommodate media having a width of 100 millimeters (3.94 inches) (Hagaki media), end walls 190 and 192 are spaced apart from one another by a distance no greater than 96 millimeters to allow the media to again overhang end walls 190 and 192 by at least 2 millimeters. The maximum distance between end walls 190 and 192 is 99 millimeters, 95.5 millimeters and 94 millimeters for 105 millimeters wide media, 101.5 wide media and 100 millimeters wide media, respectively, when the media is to nominally overhang end walls 190 and 192 by 3 millimeters.

In the particular embodiment illustrated, whatever media is being printed upon is directed and guided such that one side edge overhangs end wall 190 by 6 millimeters. As a result, end wall 192 is spaced from end wall 190 by a distance no greater than 92 millimeters, enabling the Hagaki medium to overhang end wall 192 by 2 millimeters. In the example shown, end wall 192 is spaced from end wall 190 by 92 millimeters. As a result, four inch wide media overhangs end wall 192 by about 3.5 millimeters. A6 media overhangs end wall 192 by about 7 millimeters. Channels 184 and 186 have a width such that the edges of the medium overhanging end walls 190 and 192 extend over and above the floors 198 and such that ink overspray returns along floors 198 to ink receiving cavity 160. As a result, channel 186 has a width greater than 6 millimeters. In the particular example shown, channel 186 has a width of about 7.3 millimeters. As noted above, A6 media has an edge that overhangs end wall 192 by the largest distance of about 7 millimeters. Accordingly, channel 186 has a width greater than 7 millimeters. In the particular example shown, channel 186 has a width of about 8.6 millimeters.

Channel 188 interrupts edge 164 and has a sufficient width parallel to the length of print zone 148 such that a medium having a reduced width may be supported and moved along edge 164 with the sides of the medium overhanging partially across channel 188. As a result, channel 188 enables printing adjacent and up to edges of a medium 144 having a reduced width. Ink ejected from printhead 62 (shown in FIG. 3) is deposited adjacent to such side edges proximate to channel 188. Overspray of ink is permitted to collect upon tapered floor 198 of channel 188 where the collected ink flows under the force of gravity into ink receiving cavity 160. Channel 188 has a length such that the deposition of overspray ink upon sidewalls 204, 206 of segments 180 and 182 is reduced or prevented so as to also minimize or prevent accidental deposition of the collected overspray ink upon an underside of medium 144.

In the particular embodiment illustrated, channel 188 has a length and is located such that a side edge of a short width medium will overhang end wall 206 by at least 2 millimeters and nominally 3 millimeters while being spaced from end wall 206 by at least 2 millimeters and nominally about 3 millimeters. In one particular embodiment, channel 188 is configured such that launching structure 162 accommodates a media having a width of about 89.0 millimeters (such as L-size media). End wall 204 is spaced from end wall 190 by a distance no greater than about 85.0 millimeters, allowing the media to overlap end walls 190 and 204 by at least 2 millimeters. In one embodiment, end walls 190 and 204 are spaced from one another by a distance no greater than 83.0 millimeters such that the side edges of the media overhang end walls 190 and 204 by the nominal distance of 3 millimeters. As described above, L-size media is guided such that one edge of the media overhangs end wall 190 by about 6 millimeters. As a result, end wall 204 is spaced from end wall 190 by a distance of about 80.5 millimeters which results in the opposite side of the L-size media overhanging end wall 204 by about 2.5 millimeters. Channel 198 has a width of about 6 millimeters such that the overhanging side edge is spaced from end wall 206 by about 3.5 millimeters.

In other embodiments, the width of edge 164, the width of segments 180 and 182, the width, location and number of channels 184, 186 and 188 may be varied depending upon the number of media having distinct widths to be accommodated by platen 150 and printing system 112. For example, the width location and number of channels 184, 186 and 188 may be configured to handle other media widths such as 5×7 mediums, 8×10 mediums, Funeral Hagaki media and others. The width, location and number of channels may also be varied depending upon the particular orientation of the media being printed upon.

As further shown by FIGS. 5 and 5A, launching structure 162 additionally includes apex 210, valley 212 and ramp 214. Apex 210, valley 212 and ramp 214 extend along edge 164 and cooperate to engage and shape medium 144 prior to medium 144 being launched from edge 164. Apex 210, valley 212 and ramp 214 are configured to guide and shape medium 144 such that medium 144 extends in an arc having an apex within the print zone 148 opposite printhead 62 (shown in FIG. 3). Apex 210 is generally the high point, while valley 212 is generally the low point along the surfaces proceeding edge 164. Ramp 214 is an inclined surface from valley 212 to edge 164. In the particular embodiment illustrated, apex 210 has a vertical height above valley 212 by approximately 0.55 millimeters. Edge 164 has a vertical height above valley 212 by approximately 0.45 millimeters. Ramp 214 is inclined at an angle of about 20 degrees with respect to a horizontal plane. Apex 210, valley 212 and ramp 214 are the particular dimensions of apex 210, valley 212 and ramp 214 are specifically chosen for shaping a medium 144 having inkjet photo media properties. In other embodiments, apex 210, valley 212 and ramp 214 may have other configurations depending upon the anticipated characteristics of medium 144.

Figure 6:
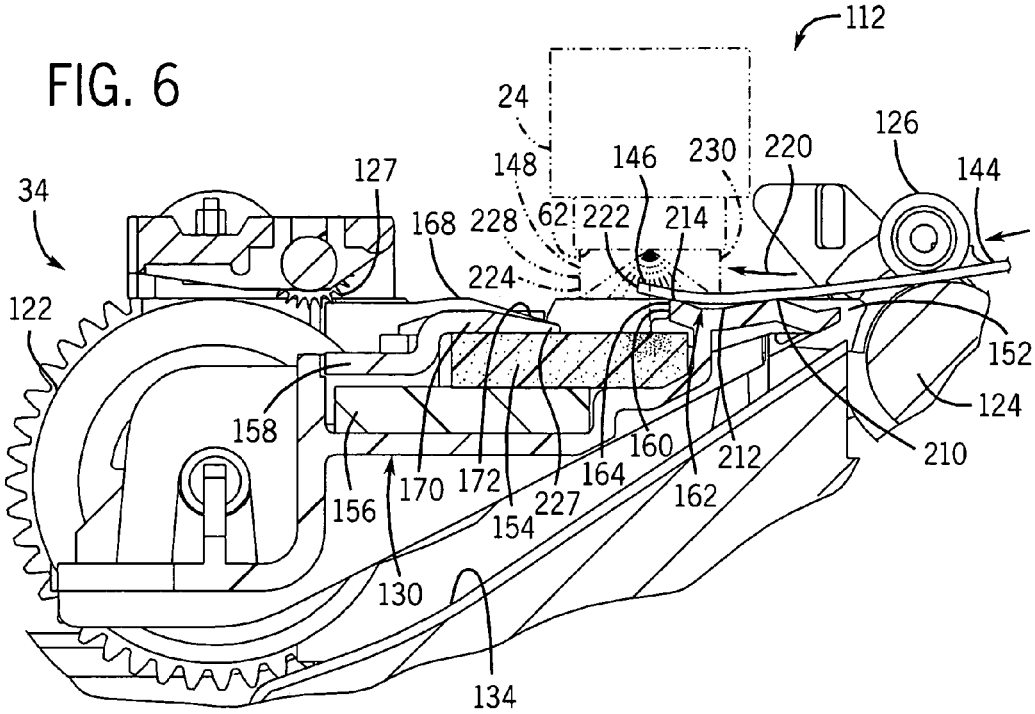
FIG. 6 is an enlarged fragmentary view of the media feed device of FIG. 4 illustrating a leading edge of a print medium being printed upon, according to an example embodiment.
Figure 7:
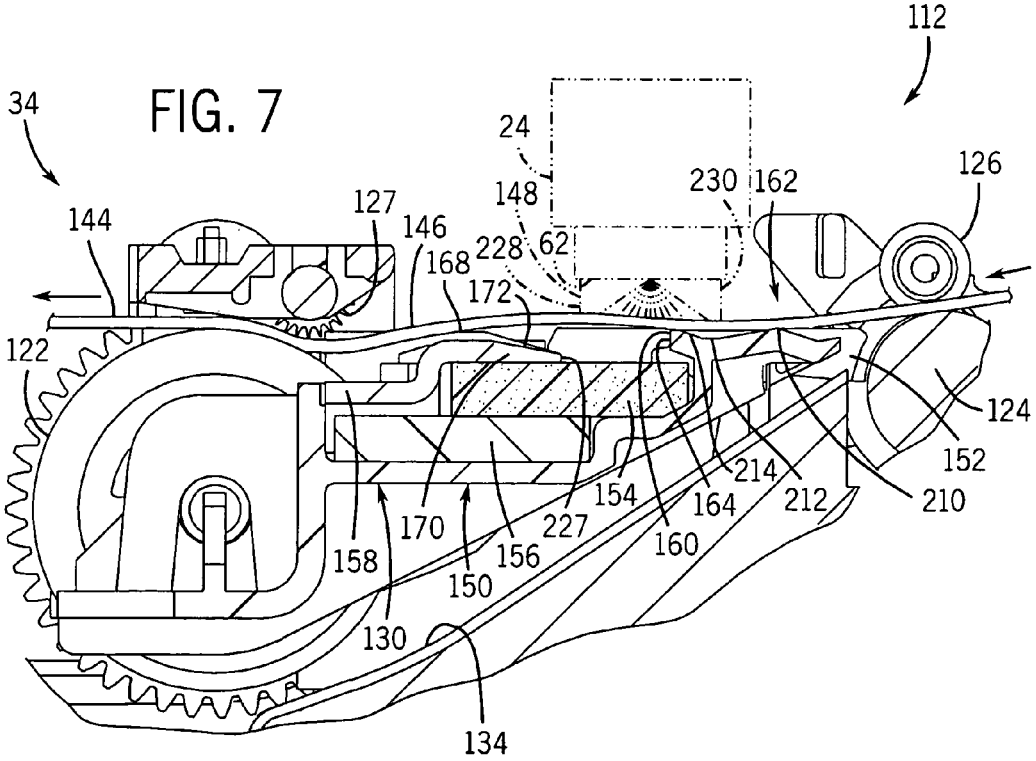
FIG. 7 is an enlarged fragmentary view of the media feed device of FIG. 4 illustrating an intermediate portion of the print medium being printed upon, according to an example embodiment.

FIGS. 6 and 7 illustrate the printing of ink upon medium 144. FIG. 6 illustrates medium 144 being initially moved through media path 146 in the direction indicated by arrows 220. FIG. 6 specifically illustrates leading edge 222 of medium 144 opposite printhead 62 partially across the length of print zone 148. As a result, printhead 62 deposits ink adjacent to leading edge 222. Overspray ink 224 passes through ink receiving cavity 160 onto ink absorber 154. Overspray ink 224 may additionally be deposited upon surface 172, whereby the ink will flow under the force of gravity to ink receiving cavity 160 and onto ink absorber 154. Ink absorber 156 wicks collected overspray ink away from ink absorber 154, increasing the capacity of ink absorber 154.

In the particular embodiment illustrated, controller 38 (shown in FIG. 1) generates control signals which cause media feed device 34 (shown in FIG. 1) to position medium 144 such that leading edge 222 overhangs edge 164 by approximately 2 millimeters when printing upon edge 222 is initiated. Edge 164 is spaced from edge 227 of cover portion 170 by approximately 6 millimeters. Printhead 62 is configured such that the length of print zone 148 has a forward most extent 228 spaced from edge 227 by approximately 1.3 millimeters and has a length of approximately 9 millimeters such that the rearward most extend 230 of print zone 148 extends beyond edge 164 over launching structure 162 by approximately 4.3 millimeters. Depending upon various factors such as the dimensions of print medium 144 and the characteristics of the ink being deposited upon print medium 144, these relative dimensions may be varied.

FIG. 7 illustrates further movement of medium 144 along media path 146. As shown by FIG. 6, launching structure 162 shapes medium 144 such that medium 144 extends in an arc over ink receiving cavity 160 with the apex of the arc generally positioned within print zone 148 opposite printhead 62. Landing portion 168, provided by cover 158, provides a landing surface for portions of medium 144 after those portions have been printed upon. In the particular embodiment illustrated, launching structure 162 and landing portion 168 cooperate to support medium 144 opposite to printhead 62 such that printhead 62 is vertically spaced from a top of medium 144 by approximately 1 millimeter, while a bottom of media 144 is spaced from a top of ink absorber 154 by approximately 2 millimeters. Print zone 148 is longitudinally spaced from edge 160 by approximately 1.3 millimeters. The exact dimensions and spacings described may be varied in particular applications depending on such factors as the size of the print zone 148 and the characteristics of medium 144 to be printed upon.

Overall, launching structure 162 facilitates accurate printing of ink adjacent to edges of a print medium while minimizing or preventing collection of overspray ink upon structures or surfaces likely to come in contact with a bottom of the print medium. Because edge 164 extends along a majority of the width of print zone 148 and is in contact with a majority of the bottom of the media being printed upon, a substantial seal between edge 164 and the bottom of the print media is formed to prevent overspray ink from traveling past edge 164 and collecting upon other surfaces of launch structure 162 which contact the bottom of the print media. At the same time, edge 164 accommodates different print media having different transverse widths.

Although launching structure 162 is illustrated as being provided by a single platen member 150 integrally formed as part of a single unitary body out of a metal or substantially rigid polymer, launching structure 162 and edge 164 may alternatively be provided by multiple members coupled to one another and formed from one or more varying materials. Although launching structure 162 and edge 164 are illustrated as being utilized in a particular printing system 112, launching structure 162 and edge 164 may alternatively be employed in other printer systems having different configurations. For example, launching structure 162 and edge 164 may alternatively be employed in a printer having a page-wide array of printheads or may be employed with a printing system that alternatively feeds media in a different manner as compared to printing system 112. Although the launching structure is disclosed for use in depositing ink along edges of a medium, structure 162 may also be used for depositing other fluids or solids along an edge of a structure.

Although the present invention has been described with reference to example embodiments, workers skilled in the art will recognize that changes may be made in form and detail without departing from the spirit and scope of the invention. For example, although different example embodiments may have been described as including one or more features providing one or more benefits, it is contemplated that the described features may be interchanged with one another or alternatively be combined with one another in the described preferred embodiments or in other alternative embodiments. Because the technology of the present invention is relatively complex, not all changes in the technology are foreseeable. The present invention described with reference to the example embodiments and set forth in the following claims is manifestly intended to be as broad as possible. For example, unless specifically otherwise noted, the claims reciting a single particular element also encompass a plurality of such particular elements.

What is claimed is:

1. A printer comprising:

a printhead along a media path having a first width; and a structure having an edge extending across a majority of the first width of the media path, wherein the edge of the structure has a first continuous segment extending along a first portion of the first width of the media path and a second continuous segment spaced from the first continuous segment extending along a second portion of the first width of the media path, wherein the first continuous segment has a second width at least about 80.5 millimeters.

2. The printer of claim 1 including an ink recipient extending across the media path.

3. The printer of claim 2, wherein the ink recipient includes an ink receiving cavity extending across the media path.

4. The printer of claim 3 including an ink absorbent material within the ink receiving cavity.

5. The printer of claim 2 including a landing opposite the edge, wherein the ink recipient extends between the edge and the landing.

6. The printer of claim 5, wherein the edge and the landing are spaced to substantially prevent a portion of a medium from making contact with collected ink of the ink recipient.

7. The printer of claim 2, wherein the structure is configured to elevate the medium above collected ink of the ink recipient by a distance of at least about 2 millimeters.

8. The printer of claim 2 including a landing opposite the structure, wherein the ink recipient extends between the landing and the structure and wherein the landing and the structure are configured to support the media such that the media extends in an arc having a concave side facing the ink recipient across the ink recipient.

9. The printer of claim 8, wherein the printhead is configured to dispense ink to the media at an apex of the arc.

10. The printer of claim 1, wherein the edge extends substantially across the media path.

11. The printer of claim 1, wherein the edge extends perpendicular to the media path.

12. The printer of claim 1 including a tapered surface adjacent the edge and configured to lift a leading edge of a medium.

13. The printer of claim 1, wherein the first segment and the second segment are spaced apart by about 6 millimeters.

14. The printer of claim 1, wherein the first segment has a second width of no greater than 85.0 millimeters and wherein the second segment is spaced from the first segment by at least 4 millimeters.

15. The printer of claim 1, wherein the first continuous segment terminates at a first end wall and a second end wall and wherein the first continuous segment has a length configured such that a first medium overhangs each of the first end wall and the second end wall by at least 2 millimeters.

16. The printer of claim 15, wherein the first end wall and the second end wall are spaced such that the first medium overhangs each of the first end wall and the second end wall by a distance of at least 3 millimeters.

17. The printer of claim 15, wherein the second continuous segment terminates at a third end wall and a fourth end wall and wherein the fourth end wall is spaced from the first end wall such that a second medium overhangs the first end wall and the fourth end wall by a distance of at least 2 millimeters.

18. The printer of claim 17, wherein the first end wall and the fourth end wall are spaced such that the second medium overhangs the first end wall and the fourth end wall by a distance of at least 3 millimeters.

19. The printer of claim 15, wherein the second continuous segment terminates at a third end wall spaced from the second end wall such that the first medium overhanging the second end wall spaced from the third end wall by a distance of at least 2 millimeters.

20. The printer of claim 1, wherein the edge extends between a first channel and a second channel and wherein the first channel and second channel each have a width of at least about 4 millimeters.

21. The printer of claim 1 including an ink receiving cavity, wherein the first segment and the second segment are separated by a channel having a tapered floor configured to drain collected ink to the ink receiving cavity.

22. The printer of claim 1, wherein the structure includes:

a first channel adjacent a first end of the first segment;

a second channel adjacent a second end of the first segment and adjacent a first end of the second segment; and a third channel adjacent a second end of the second segment.

23. The printer of claim 22, wherein each of the first channel, the second channel and the third channel has a width of at least about 4 millimeters.

24. The printer of claim 22, wherein each of the first channel, the second channel and the third channel has a tapered floor.

25. The printer of claim 1, wherein the edge is configured to contact an underside of a supported medium.

26. The printer of claim 25, wherein the edge is configured to contact the underside of the supported medium at a location opposite a portion of a top side of the supported medium as the portion is being printed upon by the printhead.

27. A platen for use in a printer including a media path, the platen comprising:

an edge configured to extend across a majority of a width of the media path while contacting a print medium, wherein the edge has a first continuous segment extending along the first portion of the width of the media path and a second continuous segment spaced from the first segment extending along a second portion of the width of the media path, wherein the first edge segment extends between a first channel and a second channel and wherein the first channel and second channel each have a width of at least about 4 millimeters.

28. The platen of claim 27 including at least one structure forming an ink receiving cavity having a width extending across the media path.

29. The platen of claim 28 including an ink absorbent material within the ink receiving cavity.

30. The platen of claim 28, wherein the at least one structure and the edge are integrally formed as part of a single unitary body.

31. The platen of claim 28 including a landing opposite the edge, wherein the ink receiving cavity extends between the first edge and the landing.

32. The platen of claim 31, wherein the edge and the landing are spaced to substantially prevent a portion of the medium from making contact with the collected ink within the ink receiving cavity.

33. The platen of claim 27, wherein the edge extends substantially across the media path.

34. The platen of claim 27, wherein the edge extends perpendicular to the media path.

35. The platen of claim 27 including a tapered surface adjacent the edge and configured to lift a leading edge of the media.

36. The platen of claim 27, wherein each of the first continuous segment and the second continuous segment has a minimum width transverse to the media path of 6 millimeters.

37. The platen of claim 27, wherein the first continuous segment terminates at the first end wall and a second end wall and wherein the first continuous segment has a length configured such that a first medium overhangs each of the first end wall and the second end wall by at least 2 millimeters.

38. The platen of claim 37, wherein the first end wall and the second end wall are spaced such that the medium overhangs the end walls by a distance of at least 3 millimeters,

39. The platen of claim 37, wherein the second continuous segment terminates at a third end wall and a fourth end wall and wherein the fourth end wall is spaced from the first end wall such that a second medium overhangs the first end wall and the fourth end wall by a distance of at least 2 millimeters.

40. The platen of claim 39, wherein the first end wall and the fourth end wall are spaced such that the second medium overhangs the first end wall and the fourth end wall by a distance of at least 3 millimeters.

41. The platen of claim 37, wherein the second continuous segment terminates at a third end wall spaced from the second end wall such that the first medium overhanging the second end wall spaced from the third end wall by a distance of at least 2 millimeters.

42. The platen of claim 27 wherein:

the first channel is adjacent a first end of the first segment;

the second channel is adjacent a second end of the first segment and adjacent a first end of the second segment; and wherein the platen further comprises:

a third channel adjacent a second end of the second segment.

43. The platen of claim 27, wherein the edge is configured to contact the underside of the supported medium at a location opposite a portion of a top side of the supported medium as the portion is being printed upon by a printhead.

44. A printer comprising:

a printhead along a media path having a first width; and a structure having an edge extending across a majority of the first width of the media path, wherein the edge extends between a first channel and a second channel and wherein the first channel and second channel each have a width of at least about 4 millimeters.

45. A printer comprising:

a printhead along a media path having a first width;

a structure having an edge extending across a majority of the first width of the media path; and an ink recipient extending across the media path, wherein the structure is configured to elevate the medium above collected ink of the ink recipient by a distance of at least about 2 millimeters.

46. A printer comprising:

a printhead along a media path having a first width;

a structure proximate a print zone of the printhead and having an edge extending across a majority of the first width of the media path; and an ink recipient extending across the media path; and a landing opposite the structure, wherein the ink recipient extends between the landing and the structure and wherein the landing and the structure are configured to support the media such that the media extends in an arc across the ink recipient.

47. A printer comprising:

a printhead along a media path having a first width;

a structure having an edge extending across a majority of the first width of the media path, wherein the edge of the structure has a first continuous segment extending along a first portion of the first width of the media path and a second continuous segment spaced from the first continuous segment extending along a second portion of the first width of the media path;

an ink recipient extending across the media path; and a landing opposite the edge, wherein the ink recipient extends between the edge and the landing.

48. The printer of claim 47, wherein the structure is configured to elevate the medium above collected ink of the ink recipient by a distance of at least about 2 millimeters.

49. The printer of claim 47 including a landing opposite the structure, wherein the ink recipient extends between the landing and the structure and wherein the landing and the structure are configured to support the media such that the media extends in an arc having a concave side facing the ink recipient across the ink recipient.

50. The printer of claim 49, wherein the printhead is configured to dispense ink to the media at an apex of the arc.

51. A printer comprising:

a printhead along a media path having a first width;

a structure having an edge extending across a majority of the first width of the media path, wherein the edge of the structure has a first continuous segment extending along a first portion of the first width of the media path and a second continuous segment spaced from the first continuous segment extending along a second portion of the first width of the media path; and an ink receiving cavity, wherein the first segment and the second segment are separated by a channel having a tapered floor configured to drain collected ink to the ink receiving cavity.

52. A printer comprising:

a printhead along a media path having a first width;

a structure having an edge extending across a majority of the first width of the media path, wherein the edge of the structure has a first continuous segment extending along a first portion of the first width of the media path and a second continuous segment spaced from the first continuous segment extending along a second portion of the first width of the media path;

a first channel adjacent a first end of the first segment;

a second channel adjacent a second end of the first segment and adjacent a first end of the second segment; and a third channel adjacent a second end of the second segment.

* * * * *

UNITED STATES PATENT AND TRADEMARK OFFICE

CERTIFICATE OF CORRECTION

PATENT NO. : 7,645,037 B2
APPLICATION NO. : 10/798509
DATED : January 12, 2010
INVENTOR(S) : Samuel A. Massey It is certified that error appears in the above-identified patent and that said Letters Patent is hereby corrected as shown below:

In column 11, line 51, in Claim 38, delete "millimeters," and insert -- millimeters. --, therefor.

Signed and Sealed this

Sixth Day of July, 2010

David J. Kappos

David J. Kappos
*Director of the United States Patent and Trademark Office*